US005328280A

United States Patent [19]

Ito

[11] Patent Number: 5,328,280

[45] Date of Patent: Jul. 12, 1994

[54] PRINTER HAVING MEANS FOR SWITCHING MEDIUM FEED PATH FROM SHEET FEED PATH TO WEB FEED PATH OR VICE VERSA

[75] Inventor: Noritsugu Ito, Chita, Japan

[73] Assignee: Brother Kogyo Kabushiki Kaisha, Aichi, Japan

[21] Appl. No.: 966,341

[22] Filed: Oct. 26, 1992

[30] Foreign Application Priority Data

Oct. 31, 1991 [JP] Japan ..... 3-286670

[51] Int. Cl.[5] ..... B41J 11/00

[52] U.S. Cl. ..... 400/596; 400/607; 400/625

[58] Field of Search ..... 400/596, 605, 607, 616, 400/616.1, 616.2, 616.3, 625

[56] References Cited

U.S. PATENT DOCUMENTS

| | | | |
|---|---|---|---|
| 4,229,113 | 10/1980 | Anderson et al. | 400/596 |
| 4,234,261 | 11/1980 | Hendrischk et al. | 400/596 |
| 4,619,197 | 10/1986 | Pailler | 400/605 |
| 4,688,957 | 8/1987 | Prevignano | 400/616 |
| 4,828,157 | 5/1989 | Yokoi | 400/616 |
| 4,934,849 | 6/1990 | Yasuoka | 400/616 |
| 4,988,226 | 1/1991 | Ito | 400/605 |
| 4,995,745 | 2/1991 | Yokoi et al. | 400/605 |
| 5,059,049 | 10/1991 | Rosenthal | 400/665 |
| 5,129,748 | 7/1992 | Brandon et al. | 400/605 |
| 5,141,346 | 8/1992 | Nakagawa | 400/605 |
| 5,158,381 | 10/1992 | Inomota | 400/605 |

FOREIGN PATENT DOCUMENTS

| | | | |
|---|---|---|---|
| 0080072 | 4/1987 | Japan | 400/607 |

*Primary Examiner*—Edgar S. Burr
*Assistant Examiner*—John S. Hilten
*Attorney, Agent, or Firm*—Oliff & Berridge

[57] ABSTRACT

A printer capable of printing selectively on cut sheets and webs, wherein feed paths along which the cut sheets and webs are fed by respective feeding devices are selected depending upon the type of the recording medium. The sheet driving device may include a sheet inlet through which a cut sheet is manually inserted, an automatic sheet feeder for delivering cut sheets from a sheet stacker, and a sheet feeding mechanism for feeding the cut sheet which is manually inserted or the cut sheets which are successively delivered from the automatic sheet feeder. A power transmitting mechanism and a power shut-off mechanism are provided to transmit a drive force from a single drive source to the appropriate one or ones of the web feeding device, automatic sheet feeder and sheet feeding mechanism.

13 Claims, 10 Drawing Sheets

PRINTER HAVING MEANS FOR SWITCHING MEDIUM FEED PATH FROM SHEET FEED PATH TO WEB FEED PATH OR VICE VERSA

BACKGROUND OF THE INVENTION

1. Field of the Invention

The present invention relates to a printer capable of printing selectively on cut sheets and webs.

2. Discussion of the Prior Art

In a known printer of the type indicated above, the cut sheets and the web are fed by respective feeding mechanisms, along respective feed paths. The sheet feeding mechanism is adapted to feed the cut sheets from a sheet inlet, through which the cut sheets are manually inserted into the sheet feed path by the user of the printer. The sheet feed path for the cut sheets is formed straight, extending from the sheet inlet and the printing portion of the printer, so that the cut sheets once fed in the forward direction toward the printing portion for printing thereon can be fed back to the sheet inlet, by the reverse operation of the sheet feeding mechanism. The web feed path which also leads to the printing portion is curved, so that the printed cut sheets cannot be fed back into the web feed path.

The known printer may include as a sheet feeding mechanism an automatic sheet feeder adapted to deliver cut sheets one after another from a sheet stacker in which a stack of cut sheets is accommodated. The automatic sheet feeder includes suitable means for separating the uppermost cut sheet from the sheet stack in the stacker. The cut sheets delivered by the automatic sheet feeder may be further advanced by a separate sheet feeding mechanism. Usually, the automatic sheet feeder, web feeding mechanism and sheet feeding mechanism are driven by respective different drive sources.

In the above printer wherein the web feed path is curved, the webs which have a relatively large thickness tend to contact the members defining the curved web feed path, because of a relatively high degree of stiffness of the webs, whereby the webs cannot be fed smoothly with high positioning accuracy, and may even suffer from jamming during their passage through the curved feed path. In the printer provided with the automatic sheet feeder, the drive source and power transmission mechanism exclusively provided for the automatic sheet feeder result in increasing the structural complexity, size and weight of the printer as a whole.

SUMMARY OF THE INVENTION

It is therefore an object of the present invention to provide a printer which is capable of feeding both cut sheets and webs with high stability and accuracy.

A second object of the invention is to provide a printer which has an automatic sheet feeder and which is simple in construction, with relatively small size and weight.

The first object may be achieved according to a first aspect of the present invention, which provides a printer comprising: a printing portion for printing on a recording medium; sheet feeding means for feeding a cut sheet as the recording medium to the printing portion, along a sheet feed path; web feeding means for feeding a web as the recording medium to the printing portion, along a web feed path; and path switching means for switching a feed path of said recording medium, from one of the sheet feed path and the web feed path, to the other of said sheet and web feed paths.

In the printer according to the first aspect of the present invention constructed as described above, the feed path of the recording medium is suitably switched from the sheet feed path to the web feed path or vice versa, depending upon the type of the recording medium. This arrangement permits the web feed path to be straight, enabling the relatively thick web to be easily fed and advanced to the printing portion, without a jamming trouble as experienced in the known printer, wherein the web feed path is curved to prevent the cut sheet from being moved back into the web feed path when the cut sheet is returned to the sheet inlet. In other words, the path switching means permits the cut sheet (which is either manually inserted or automatically supplied) to be returned back to the sheet inlet, even through the web feed path is straight, namely, the path switching means eliminates the conventional need for curving the web feed path to prevent the cut sheet from being returned to a web tractor, for example.

The path switching means may comprise a movable paper guide, and a moving device for moving the paper guide between a sheet guiding position in which the paper guide guides the cut sheet along the sheet feed path, and a web guiding position in which the paper guide guides the web along the web feed path.

The sheet feeding means may comprise a sheet supply portion from which the cut sheet is supplied, and path defining means for defining the sheet feed path. In this case, the web feed path includes a substantially straight portion, and the sheet feed path includes a first portion which extends between the sheet supply portion and a point on the straight portion of the web feed path, and a second portion which extends between the above-indicated point and the printing portion. Further, the path switching means comprises a movable paper guide disposed at the above-indicated point, and a moving device for moving the paper guide between a web guiding position in which the paper guide guides the web along the web feed path, and a sheet guiding position in which the paper guide cuts the web feed path at the point and in which the paper guide guides the cut sheet along the sheet feed path.

The second object indicated above as well as the first object may be achieved according to a second aspect of this invention, which provides a printer comprising: a printing portion for printing on a recording medium; sheet feeding means including a sheet inlet through which a cut sheet as the recording medium is manually inserted, an automatic sheet feeder having a sheet stacker for delivering cut sheets as the recording medium one after another from the sheet stacker, and a sheet driving device for selectively moving to the printing portion along a sheet feed path, the cut sheet manually inserted through the sheet inlet, and the cut sheets delivered from the automatic sheet feeder; web feeding means for feeding a web as the recording medium to the printing portion, along a web feed path; path switching means for switching a feed path of the recording medium, from one of the sheet feed path and the web feed path to the other of the sheet and web feed paths; a single drive source for generating a drive force to drive the automatic sheet feeder, the sheet driving device and the web feeding means; a power transmitting mechanism for transmitting the drive force from the single drive source to the automatic sheet feeder, the sheet driving device and the web feeding means; and power shut-off means for inhibiting the transmission of the drive force from the single drive source to the automatic sheet feeder and the web feeding means when the cut sheet manually inserted through the sheet inlet is fed along the sheet feed path, the power shut-off means further inhibiting the transmission of the drive force from the single drive source to the automatic sheet feeder when the web is fed along the web feed path.

The printer constructed according to the second aspect of this invention as described just above, which also includes the path switching means, has the same advantage as the printer constructed according to the first aspect of the invention described above. Further, the instant printer uses a single drive source for driving the sheet driving device, automatic sheet feeder and web feeding means, through the power transmitting mechanism. When the manually inserted cut sheet is fed along the sheet feed path, the transmission of the drive force of the drive source to the automatic sheet feeder and the web feeding means is inhibited by the power shut-off means. When the web is fed along the web feed path, the power shut-off means inhibits the transmission of the drive force to the automatic sheet feeder.

The power shut-off means not only permits the use of a single drive source for the sheet driving device, automatic sheet feeder and web feeding means, but also prevent the feeding of the web from the web feeding means when the cut sheets are supplied from the automatic sheet feeder, or the feeding of the cut sheets from the automatic sheet feeder when the manually inserted cut sheet is fed. Accordingly, the present printer is simplified in construction, and reduced in size and weight, and is free from medium feeding errors such as simultaneous feeding of the web and the manually insert cut sheet.

The second object may also be achieved according to a third aspect of this invention, which provides a printer comprising: a printing portion for printing on a recording medium; sheet feeding means including a sheet inlet through which a cut sheet as the recording medium is manually inserted, an automatic sheet feeder having a sheet stacker for delivering cut sheets as the recording medium one after another from the sheet stacker, and a sheet driving device for selectively feeding to the printing portion along a sheet feed path, the cut sheet manually inserted through the sheet inlet, and the cut sheets delivered from the automatic sheet feeder; web feeding means for feeding a web as the recording medium to the printing portion, along a web feed path; a single drive source for generating a drive force to drive the automatic sheet feeder, the sheet driving device and the web feeding means; a power transmitting mechanism for transmitting the drive force from the single drive source to the automatic sheet feeder, the sheet driving device and the web feeding means; and power shut-off means for inhibiting the transmission of the drive force from the single drive source to the automatic sheet feeder and the web feeding means when the cut sheet manually inserted through the sheet inlet is fed along the sheet feed path, the power shut-off means further inhibiting the transmission of the drive force from the single drive source to the automatic sheet feeder when the web is fed along the web feed path.

The printer according to the third aspect of the invention is identical to that according to the second aspect of the invention, except for the absence of the path switching means, and is simple in construction and has reduced size and weight, owing to the use of a single drive source for the sheet driving device, automatic sheet feeder and web feeding means, as described above with respect to the second aspect of the invention.

BRIEF DESCRIPTION OFT HE DRAWINGS

The above and other objects, features and advantages of the present invention will be better understood by reading the following detailed description of a presently preferred embodiment of this invention, when considered in connection with the accompanying drawings, in which.

Figure 4:
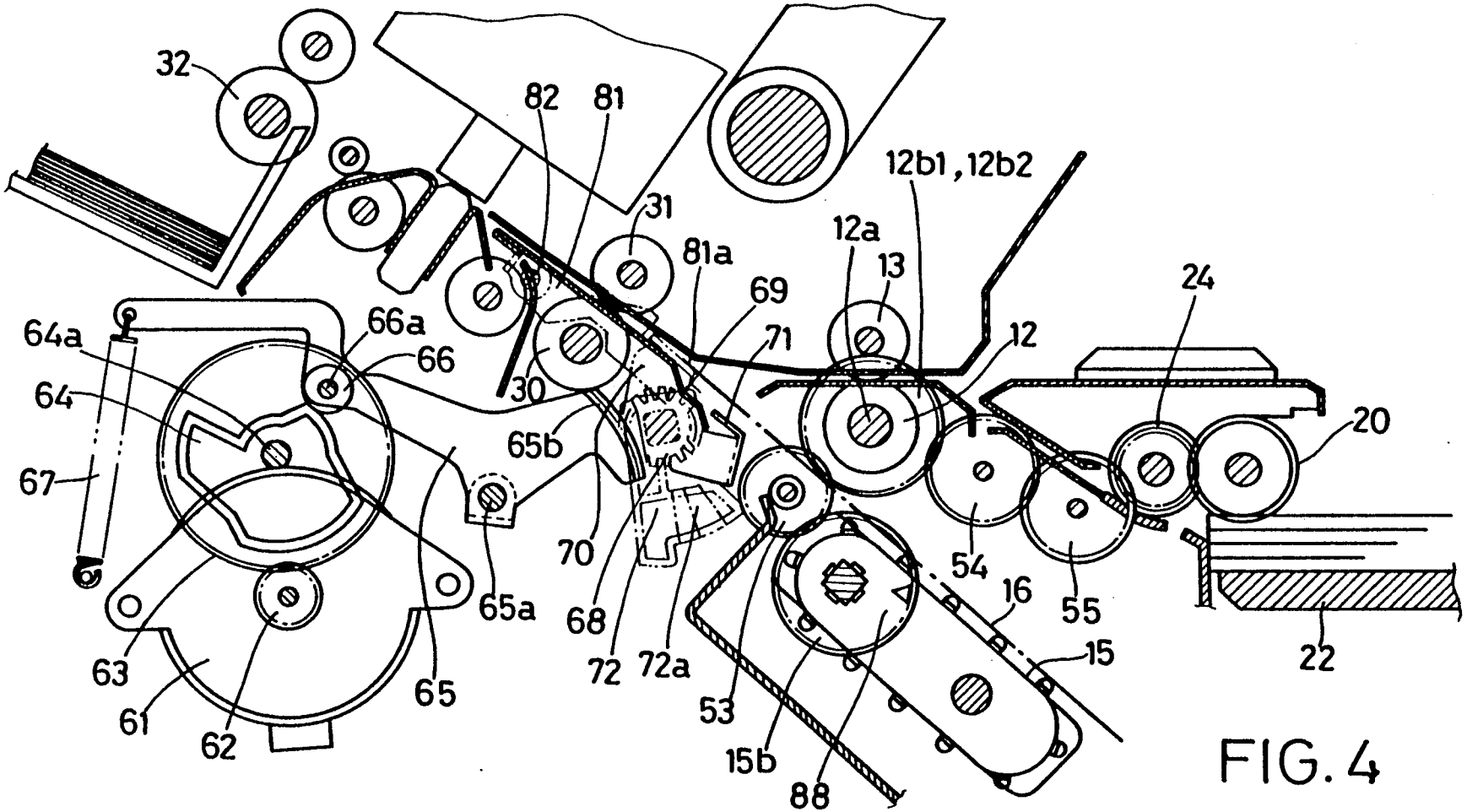
FIG. 4 is an enlarged schematic cross sectional view showing a power shut-off mechanism and a feed path selecting mechanism of the power transmission mechanism of FIG. 2 placed in a position to feed the web from the front tractor.
Figure 8A:
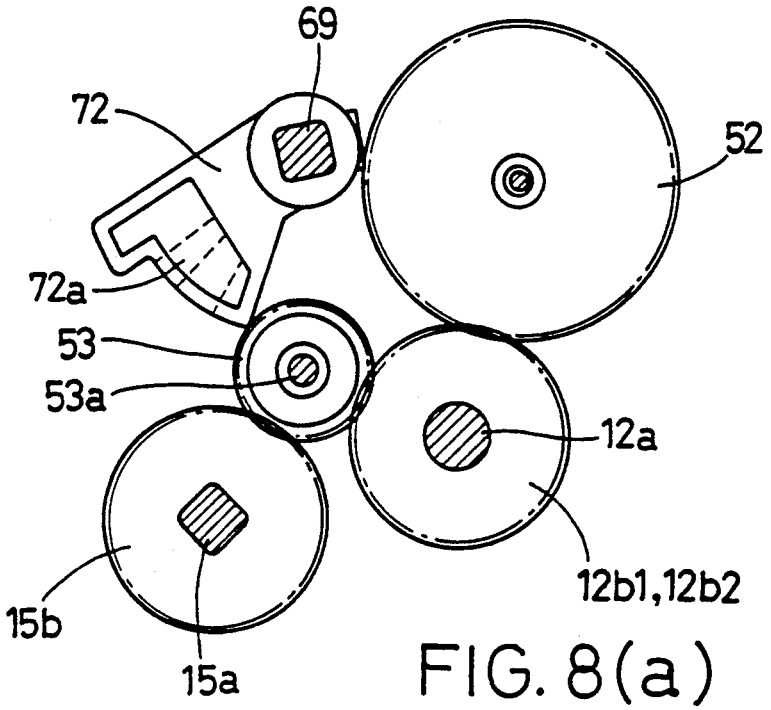
Figure 8B:
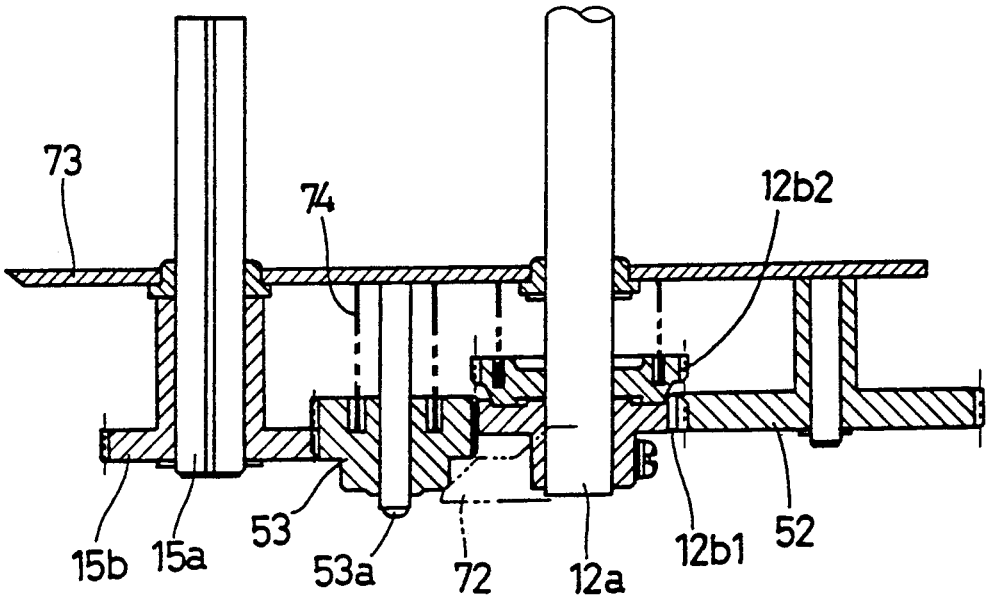
Figure 9A:
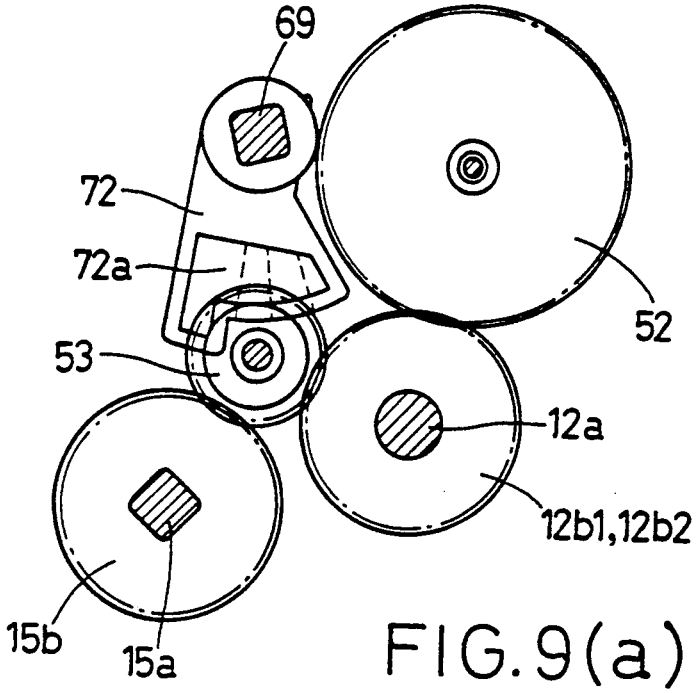
Figure 9B:
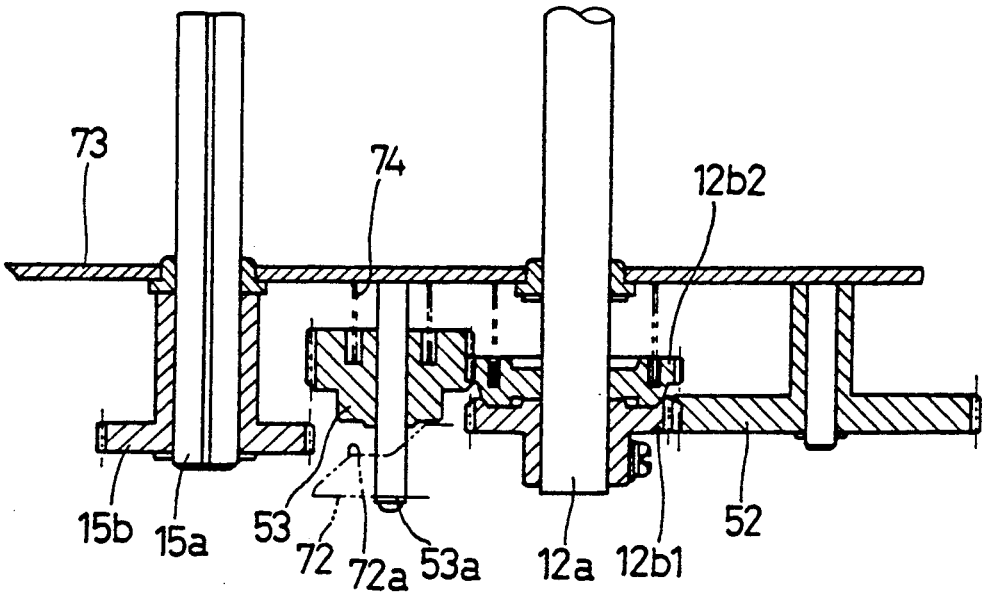
Figure 10A:
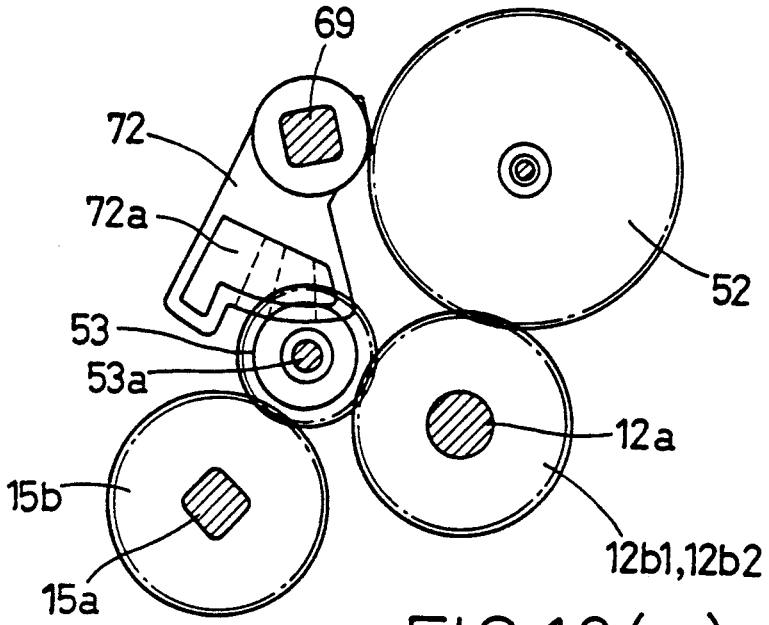
Figure 10B:
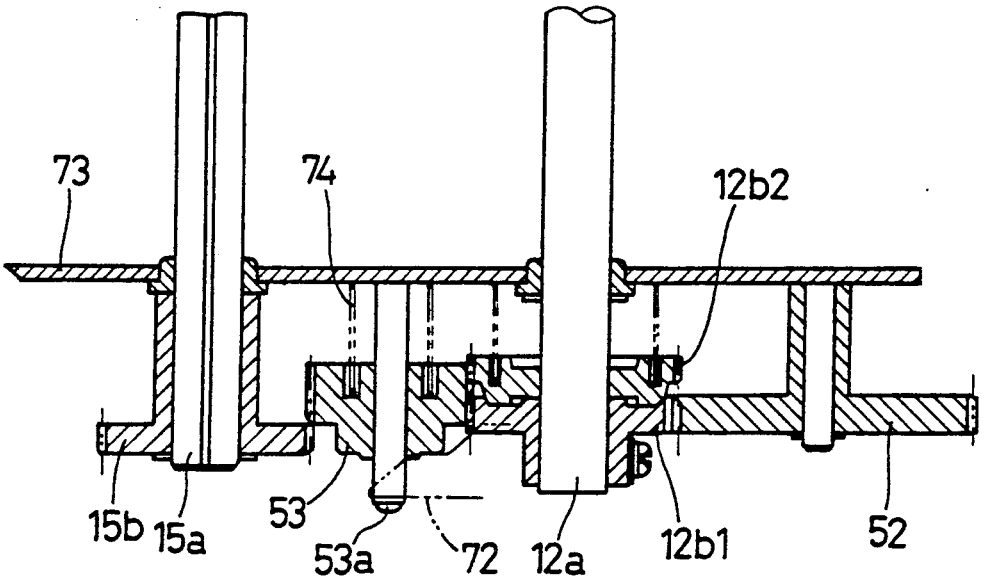

FIGS. 8(*a*) and 8(*b*) are views for explaining the operation of the power shut-off mechanism of FIG. 4 when the web is fed from the front tractor;

FIGS. 9(*a*) and 9(*b*) are views for explaining the operation of the power shut-off mechanism of FIG. 4 when the cut sheet is manually inserted; and FIGS. 10(*a*) and 10(*b*) are views for explaining the operation of the power shut-off mechanism of FIG. 4 when the cut sheets are fed from the automatic sheet feeder.

DETAILED DESCRIPTION OF THE PREFERRED EMBODIMENT

Figure 1:
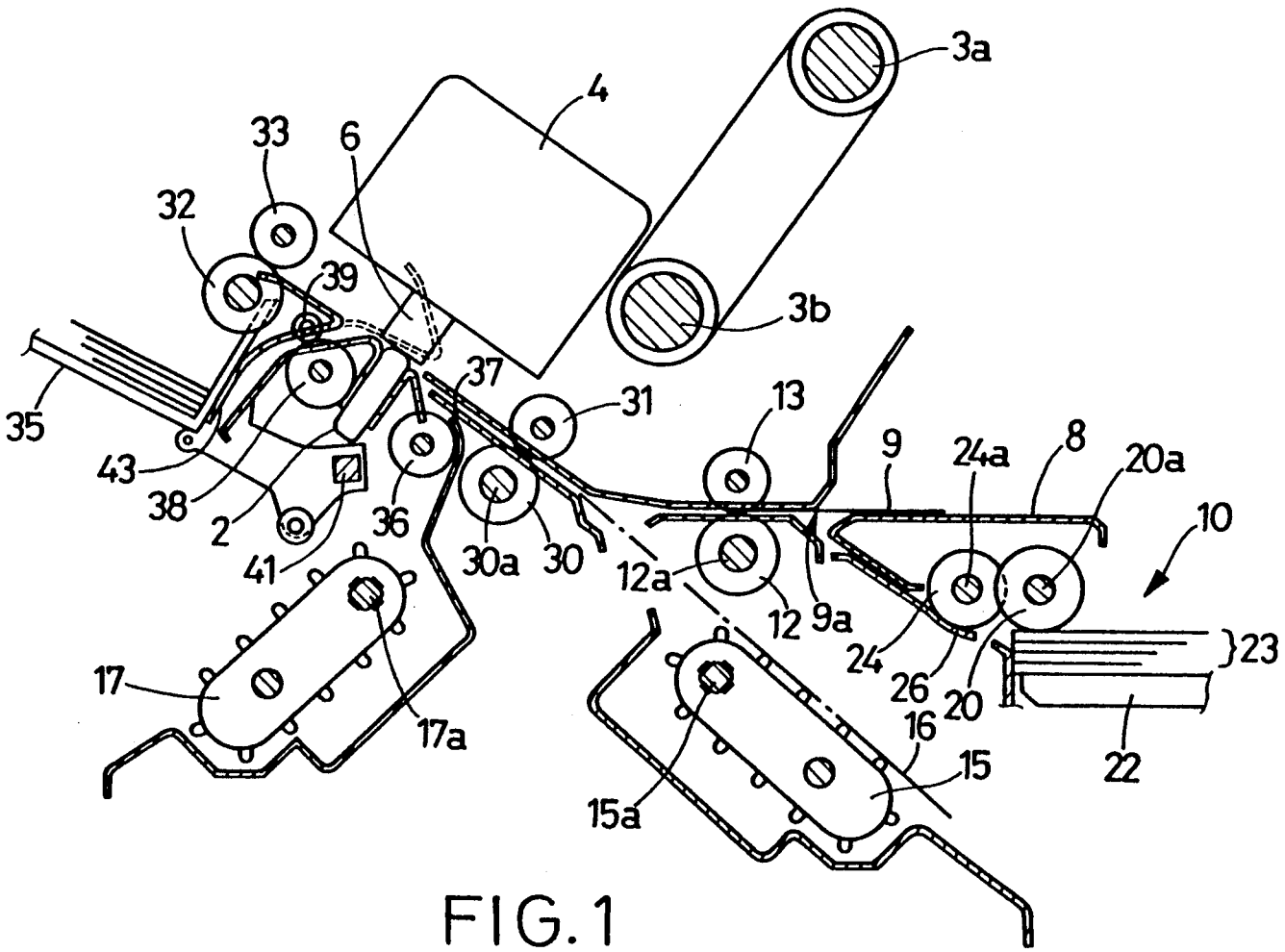
FIG. 1 is a schematic right-hand side elevational view in cross section of a part of a printer adapted to feed various types of recording medium, which is constructed according to one embodiment of the present invention.

Referring first to the right-hand side elevational view of FIG. 1, the printer has a printing portion which includes a platen 2, and a print head 4 mounted on a carriage which is slidably supported by a pair of parallel guide shafts 3*a*, 3*b*, which extend parallel to the platen 2. As well known in the art, the carriage is reciprocated in the direction of extension of the platen 2 and guide shafts 3*a*, 3*b*, by a suitable carriage feed motor via a timing belt. In operation of the printer, the print head 4 effects printing of successive lines on a recording medium as the medium is fed and advanced across the platen 2, in the direction perpendicular to the direction of extension of the platen 2.

In the front section (right-hand side section as seen in FIG. 1) of the printer, a sheet support 8 is disposed adjacent a sheet supply portion in the form of a sheet inlet 9*a*, so that the user of the printer may manually insert the recording medium in the form of a cut sheet 9 into a sheet feed path which is partially defined by a nip of a feed roll 12 and a pinch roll 13. Below the sheet support 8, there is provided a sheet supply portion in the form of an automatic sheet feeder generally indicated at 10. As described in detail, the automatic sheet feeder 10 is adapted to deliver cut sheets 23 one after another into the sheet feed path through the sheet inlet 9*a*. The feed and pinch rolls 12, 13 constitute a part of a sheet feeding device for feeding to the printing portion 2, 4, the cut sheet 9 manually inserted through the sheet inlet 9*a*, and the cut sheets 23 delivered from the automatic sheet feeder 10. Below the feed and pinch rolls 12, 13 of the sheet feeding device, there is disposed a front tractor 15 for feeding the recording medium in the form of a web 16 indicated in one-dot chain line in FIG. 1. The printer further has a rear tractor 17 disposed below the printing portion 2, 4, namely, in the rear section (left-hand side section as seen in FIG. 1) of the printer. The rear tractor 17 is also adapted to feed a web toward the printing portion 2, 4.

As is apparent from the following description, the front tractor 15 is associated with the principle of the present invention, which does not involve the rear tractor 17, in this particular embodiment of the invention.

The automatic sheet feeder 10 includes a pick-up roll 20 which is rotated about its shaft 20*a*. The pick-up roll 20 is held in contact with the top of a stack of cut sheets 23 accommodated in a sheet stacker tray 22. More specifically, the uppermost cut sheet 23 of the sheet stacker is carried by the rotation of the pick-up roll 20, to a separator roll 24 which is rotated about its shaft 24*a*. The separator roll 24 cooperates with the front portion of a separator pad 26 to feed the uppermost cut sheet 23 along the rear portion of the separator pad 26, to the nip of the feed and pinch rolls 12, 13, via the sheet inlet 9*a*. When printing is effected on the successive cut sheets 23, the cut sheets are fed one after another, one sheet at a time.

Between the nip of the feed and pinch rolls 12, 13 and a printing station between the platen 2 and a nose 6 of the print head 4, there are provided another set of feed and pinch rolls 30, 31. The manually inserted cut sheet 9 or the automatically delivered cut sheet 23, and the web 16 are fed or advanced to the printing station, by the rotation of the feed roll 30 in rolling contact with the pinch roll 31, such that the sheet 9, 23 or web 16 is passed through the nip of the rolls 30, 31. The printed cut sheet 9, 23 or the printed portion of the web 16 is further advanced by another set of feed and pinch rolls 32, 33, and is ejected into a sheet stacker 35, with the sheet 9, 23 or web 16 passing through the nip of the rolls 32, 33. The sheet stacker tray 22 and the sheet stacker 35 are thus located at the front and rear ends of the printer.

Between the rear tractor 17 and the printing station, there is disposed a feed roll 36, which cooperates with the upper end portion of a paper pan 37 adjacent to the feed roll 30, to advance a web (not shown) fed from the rear tractor 17. Between the printing station and the feed and pinch rolls 32, 33, there is provided a still further set of feed and pinch rolls 38, 39 whose nip partially define a discharge path for ejecting the printed portion of the web from the rear tractor 17, to a position below the stacker 35. However, if the web fed from the rear tractor 17 has a relatively small thickness and an accordingly small degree of stiffness, this web may be ejected through the nip of the feed and pinch rolls 32, 33, into the sheet stacker 35, by pivoting a paper guide 43 about a shaft 41 (having a square cross sectional shape), as described blow.

The paper guide 43 is pivotally supported by the shaft 41 and is pivoted by an actuator in the form of a cam (not shown), between a guiding position indicated in solid line, in which the paper guiding portion of the paper guide 43 defines the discharge path indicated above, and a non-guiding position indicated in dashed lines, in which the paper guiding portion is offset from a path between the printing station and the nip of the feed and pinch rolls 32, 33. In the non-guiding position of the paper guide 43, the printed portion of the web from the rear tractor 17 is passed through the nip of the feed and pinch rolls 32, 33 and is ejected into the rear stacker 35.

Figure 2:
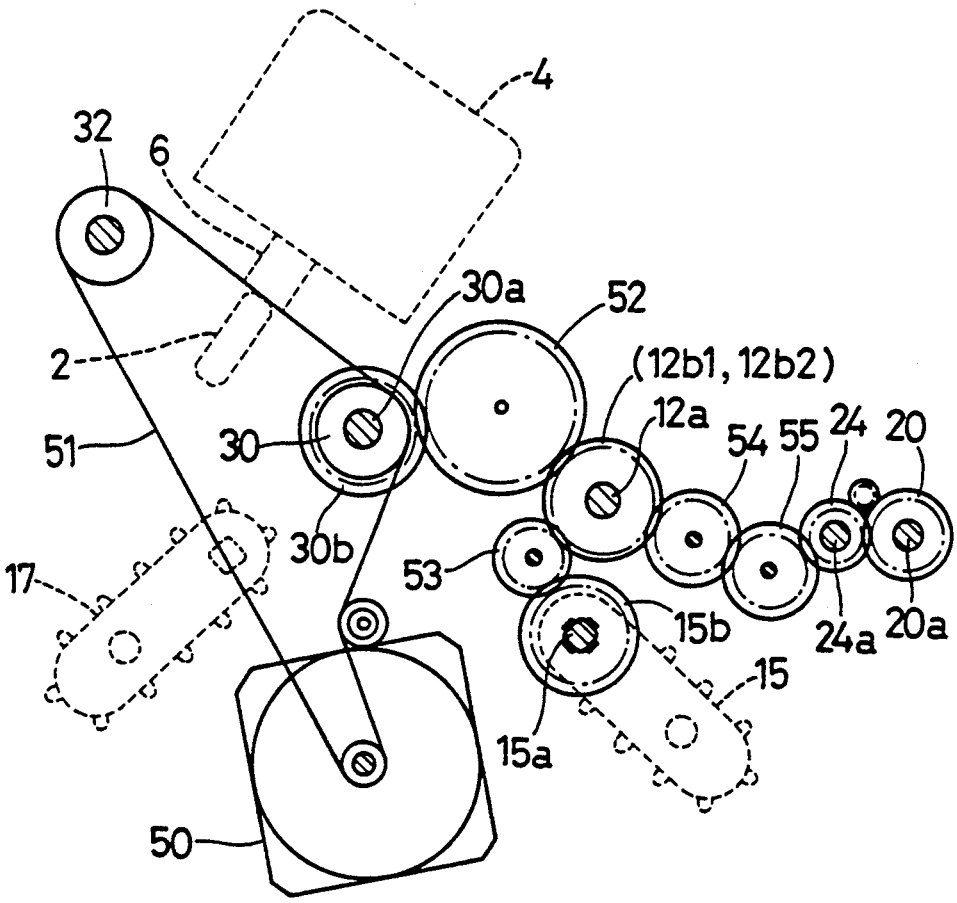
FIG. 2 is schematic view showing a power transmission system for feeding cut sheets and a web from an automatic sheet feeder and a front tractor, respectively, which are provided in a relatively front section of the printer of FIG. 1.

Referring next to FIG. 2, there is shown a drive system for rotating: the feed roll 12 for feeding the cut sheet 9 or 23; the pick-up roll 20 of the automatic sheet feeder 10 for feeding the cut sheets 23; the front tractor 15 for feeding the web 16; the feed roll 30 for advancing the cut sheet 9, 23 or web 16; and the feed roll 32 for ejecting the cut sheet 9, 23 and web 16 (and the web from the rear tractor 17).

As shown in FIG. 2, the drive system includes a single drive source in the form of a first drive motor 50, to which is connected the feed rolls 30, 32 through a timing belt 51. The feed roll 30 is rotated with a shaft 30 to which is fixed a drive gear 30*b*. The shaft 12*a* of the feed roll 12 has a drive gear 12b1 fixed thereof. The drive gears 30*b* and 12b1 mesh with an idler gear 52, so that the feed roll 12 is rotated by the first drive motor 50, through the timing belt 51, drive gear 30*b*, idler gear 52 and drive gear 12b1.

The front tractor 15 has a drive shaft 15*a* having a square cross sectional shape, and a drive gear 15*b* fixed to the drive shaft 15*a*. A rotary motion of the drive gear 12b1 of the feed roll 12 is transmitted to the drive gear 15*b* of the tractor 15, through an idler gear 53 disposed between the drive gears 12b1 and 15*b*, whereby the tractor 15 is driven by the first drive motor 50. The rotary motion of the drive gear 12b1 of the feed roll 12 is transmitted to the feed roll 20 and separator roll 24 of the automatic sheet feeder 10, through an idler roll 12b2 provided on the shaft 12*a*, and two idler rolls 54, 55 disposed between the idler gear 12b2 and the separator roll 24. As shown in FIG. 8(*b*), the idler roll 12b2 is disposed adjacent to the drive gear 12b1, such that the idler roll 12b2 is rotatable relative to the shaft 12, but is not axially movable relative to the shaft 12*a*.

The shafts 20*a*, 24*a* of the pick-up and separator rolls 20, 24 are provided with suitable clutch mechanisms such as electromagnetic clutches which are operated to rotate only the separator roll 24 in the sheet feeding direction, or alternatively both of the pick-up and separator rolls 20, 24 in the sheet feeding direction, so that the uppermost cut sheet 23 in the stacker tray 22 can be easily separated from the stack of the remaining cut sheets 23 in the tray 22.

The idler gear 53 is axially movable and has three operating positions, which are selectively established by suitable power shut-off means, to inhibit the transmission of the rotary motion of the drive gear 12b1 of the feed roll 12 to the automatic sheet feeder 10 and/or the front tractor 15, as described below in detail.

Figure 3:
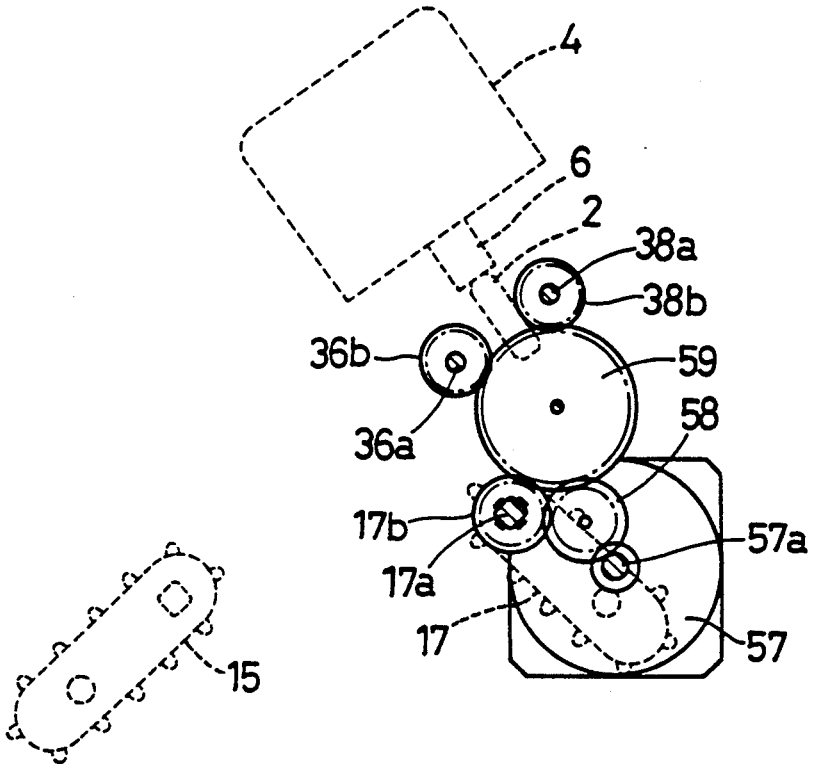
FIG. 3 is a schematic right-hand side elevational view showing a power transmission system for feeding a web from a rear tractor provided in a relatively rear section of the printer.

Referring next to the elevational view of FIG. 3, there will be described a drive system for the rear tractor 17, and the feed rolls 36 and 38. It is noted that FIG.

3 is the right-hand side elevation of the printer, while FIG. 1 is the left-hand side elevation.

The drive system for the rear tractor 17 uses a drive source in the form of a second drive motor 57 whose drive shaft 57*a* meshes with an idler gear 58. The tractor 17 has a drive shaft 17*a* (having a square cross sectional shape) and a drive gear 17*b* fixed to the shaft 17*a*. The drive gear 17*b* meshes with the idler gear 58, whereby the drive shaft 17*a* is rotated by the drive motor 57 through the idler gear 58. The feed rolls 36, 38 have respective shafts 36*a*, 38*a* and drive gears 36*b*, 38*b* secured to the drive shafts 36*a*, 38*a*, respectively. The drive gears 36*b*, 38*b* meshes with an idler gear 59, which in turn meshes with the idler gear 58, so that the feed rolls 36, 38 are rotated by the drive motor 57 through the idler gears 58, 59.

It will be understood from the above description that the cut sheet 9 or 23 from the sheet support 8 or automatic sheet feeder 10, or the web 16 from the front tractor 15 is advanced through the printing station and ejected onto the rear sheet stacker 35, by the drive system which includes the first drive motor 50, and that the web from the rear tractor 17 is advanced through the printing station and ejected through the discharge path defined by the nip of the feed and pinch rolls 38, 39 and the paper guide 43, by the drive system which includes the second drive motor 57. It will also be understood that the web from the rear tractor 17 can be ejected onto the rear sheet stacker 35, by the two drive systems which include the respective first and second drive motors 50, 57.

Referring to FIGS. 4–10, there will next be described the above-indicated power shut-off means incorporated in the power transmitting mechanism for the feed roll 12, automatic sheet feeder 10 and front tractor 15, and path switching means for selectively establishing the sheet feed path for the cut sheets 9, 23 or the web feed path for the web 16. In other words, the path switching means functions to perform switching from one of the sheet and web feed paths to the other feed path.

Figure 5:
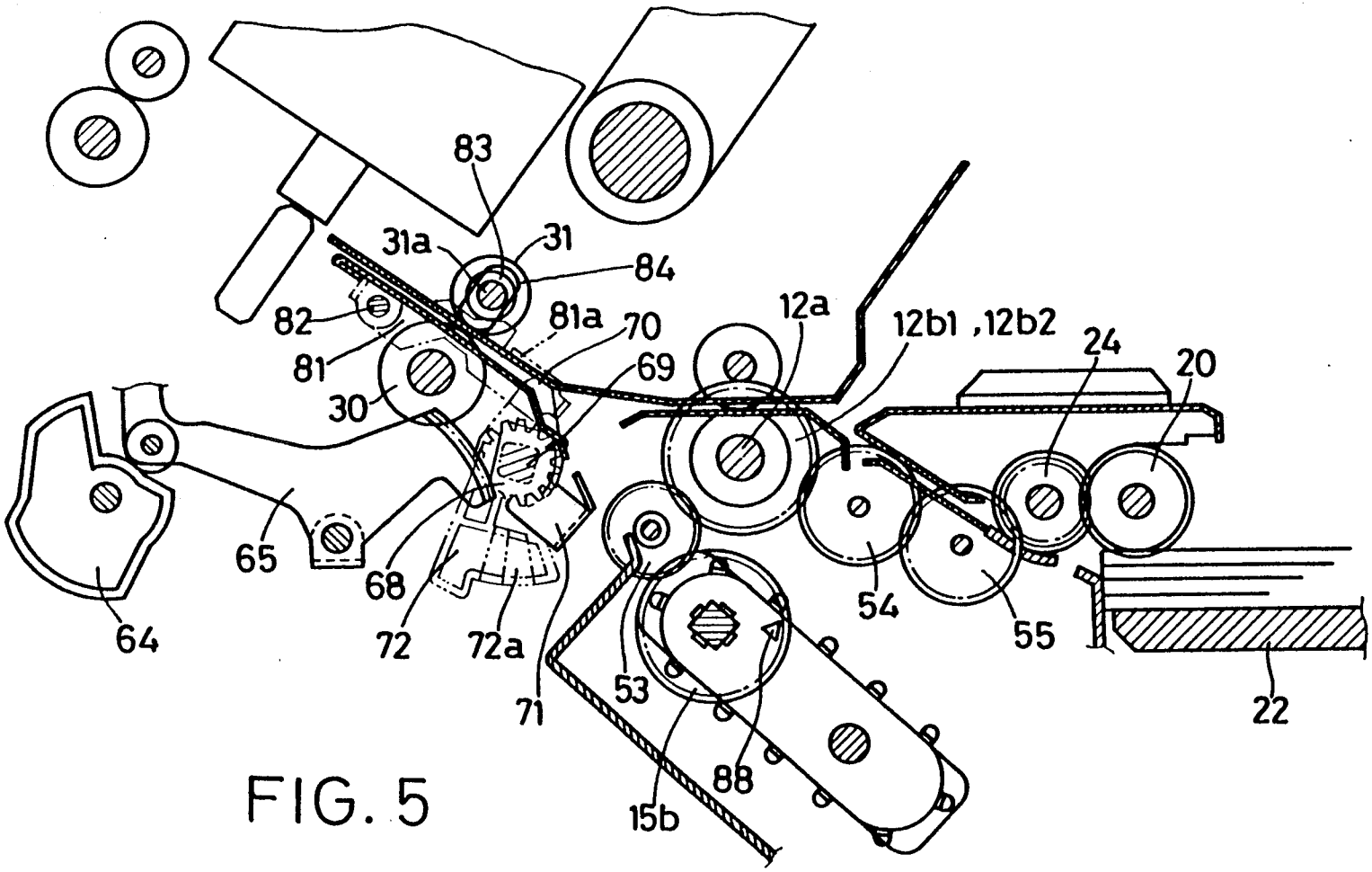
FIG. 5 is an enlarged cross sectional view showing the mechanisms of FIG. 4 when printing is effected on the web fed from the front tractor.
Figure 6:
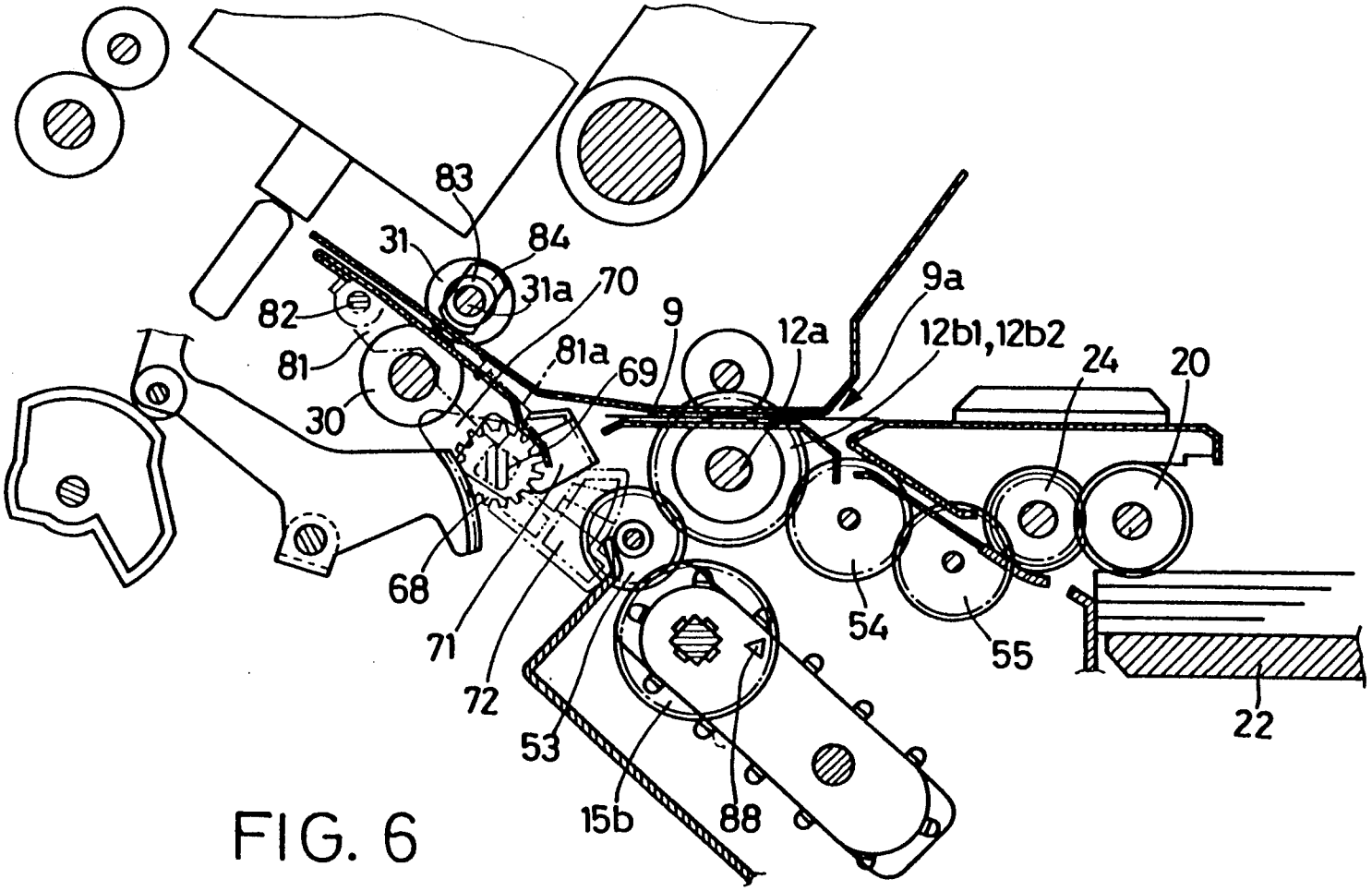
FIG. 6 is an enlarged cross sectional view showing the mechanisms of FIG. 4 when the cut sheet is manually inserted through a sheet inlet.
Figure 7:
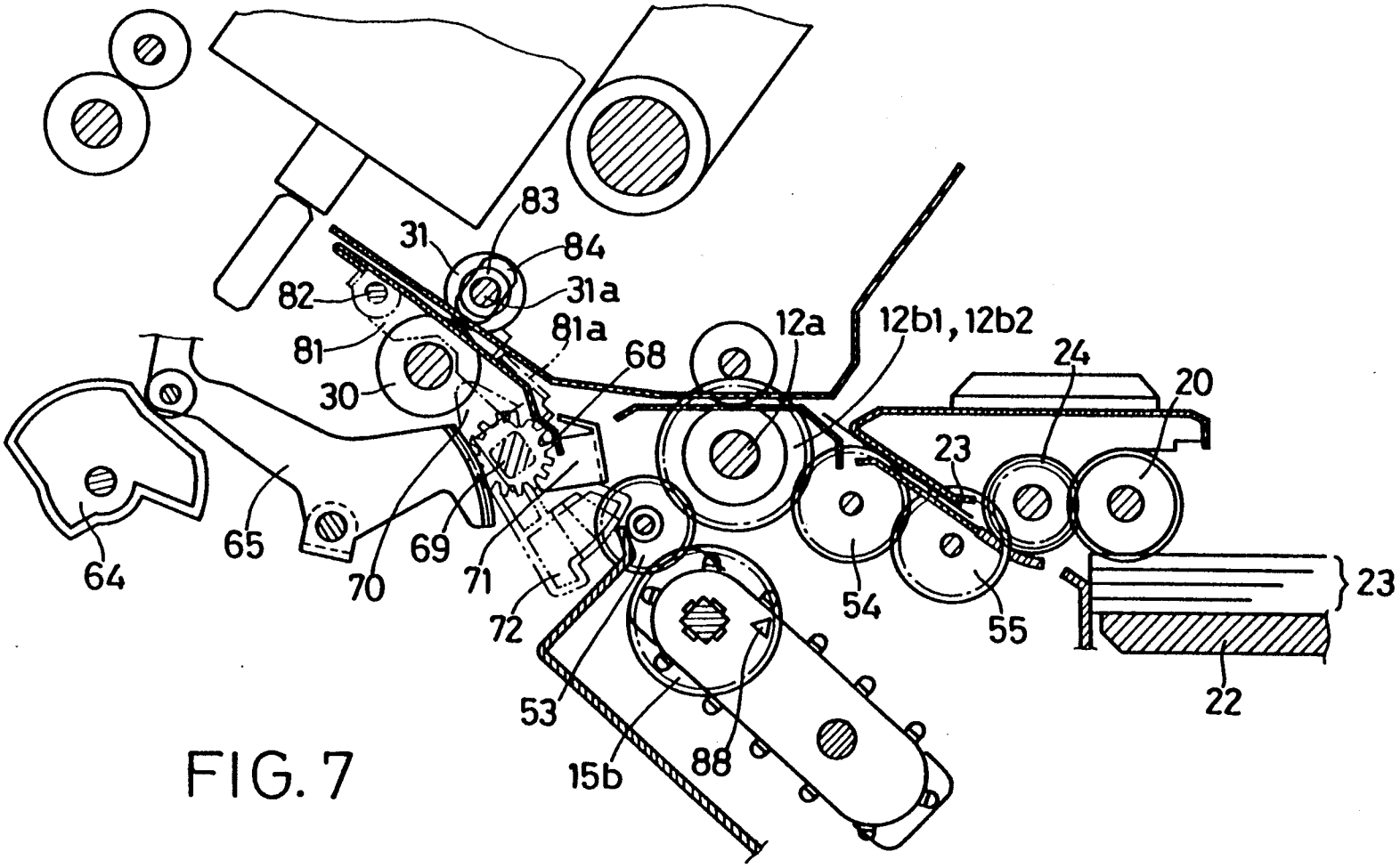
FIG. 7 is an enlarged cross sectional view showing the mechanisms of FIG. 4 when the cut sheets are delivered and fed from the automatic sheet feeder.

The printer as shown in FIG. 4 is placed in a position for feeding the web 16 from the front tractor 15 until the leading end of the web 16 has passed the nip of the feed and pinch rolls 30, 31. The printer as shown in FIG. 5 is placed in a position for printing on the web 16. The printer as shown in FIG. 6 is placed in a position for feeding the manually inserted cut sheet 9 and for printing on the cut sheet 9. The printer as shown in FIG. 7 is placed in a position for feeding the cut sheets 23 from the automatic sheet feeder 10 and for printing on the cut sheets 23.

FIGS. 8, 9 and 10 show the power shut-off means incorporated in the power transmitting mechanism for the feed rolls 12, 30, 32, automatic sheet feeder 10, and front tractor 15. The power shut-off means as shown in FIGS. 8(*a*) and 8(*b*) is placed in a position for feeding the web 16, and the power shut-off means as shown in FIGS. 9(*a*) and 9(*b*) is placed in a position for feeding the manually inserted cut sheet 9. The power shut-off means as shown in FIGS. 10(*a*) and 10(*b*) is placed in a position for delivering and feeding the cut sheets 23 from the automatic sheet feeder 10.

The path switching means uses a main cam 64 which is rotated about a cam shaft 64*a*, as shown in FIG. 4. The main cam 64 is rotated by a cam drive motor 61, through a gear 62 connected to the motor 61, and a gear 63 which meshes with the gear 62 and which is rotated with the shaft 64*a*. In this arrangement, the main cam 64 is rotated by the motor 61 through the gears 62, 63. The path switching means also uses an actuator lever 65 which is supported by a lever shaft 65*a* pivotally about the axis of the shaft 65*a*. The actuator lever 65 has a first arm which carries a follower roll 66, which is rotatable about a pin 66*a*. The actuator lever 65 is biased by a tension spring 67 which acts on the free end of the first arm, so that the follower roll 66 is held in contact with the periphery of the primary cam 64. As the main cam 64 is rotated by the cam drive motor 61, the actuator lever 65 is pivoted about the lever shaft 65*a*, with the follower roll 66 moving in rolling contact with the main cam 64.

The actuator lever 65 also has a second arm which has a toothed portion 65 at its free end, as shown in FIG. 4. This toothed portion 65 engages a gear 68 fixed to a shaft 69, which has a square cross sectional shape. The shaft 69 is rotated by a pivotal motion of the actuator lever 65, through the toothed portion 65*b*. The gear 68 is formed integrally with a first auxiliary cam 70.

The shaft 69 is rotatably supported by left and right frames of the printer, one of which is indicated at 73 in FIGS. 8(*b*), 9(*b*) and 10(*b*). To the shaft 69, there are also secured a paper guide 71 and a second auxiliary cam 72. When the actuator lever 65 is pivoted by the motor 61, the shaft 69, first and second auxiliary cams 70, 72 and paper guide 71 are rotated as a unit. Consequently, the paper guide 71 functions to partially define a web feed path for the web 16, or a sheet feed path for the cut sheets 9, 23, that is, selects the web feed path or the sheet feed path. More specifically, the paper guide 71 has a web guiding position of FIG. 4, and a sheet guiding position of FIGS. 6 and 7. In the web guiding position, the paper guide 71 completes the straight web feed path which extends between the automatic sheet feeder 10 and the printing station between the platen 2 and the nose 6 of the print head 4, so that the web 16 can be fed and advanced along the straight web feed path. Since the web feed path is straight, the web 16 can be easily fed, even if the thickness of the web 16 is relatively large. In the sheet guiding position, the paper guide 71 completes the sheet feed path, by connecting a path between the sheet inlet 9*a* and the paper guide 71, to a portion of the web feed path between the paper guide 71 and the printing station. Namely, the sheet feed path is bent at the paper guide 71, such that the paper guide 71 functions to smoothly direct the cut sheet 9, 23 toward the nip of the feed and pinch rolls 30, 31. Thus, the paper guide 71 functions to switch the medium feed path from one of the sheet and web feed paths to the other feed path.

As shown in FIG. 8(*a*), the second auxiliary cam 72 has a cam surface 72*a*, which is most clearly indicated in FIG. 9(*b*). The cam 72 is positioned such that the idler gear 53 lies on a path taken by the cam surface 72*a* when the cam 72 is rotated about the shaft 69, so that the cam surface 72*a* engages the idler gear 53 and thereby axially move the idler gear 53 as the cam 72 is rotated. As shown in FIG. 8(*b*), the idler gear 53 is rotatably supported by a shaft 53*a* attached to the frame 73 of the printer. The idler gear 53 is biased in a direction away from the frame 74, by a compression spring 74 provided between the frame 74 and the gear 53.

When the cam surface 72*a* is not in contact with the idler gear 53, as shown in FIG. 8(*a*), the idler gear 53 is held in the position of FIG. 8(*b*) under the biasing action of the spring 74, in which the idler gear 53 engages the gear 15*b* of the front tractor 15, as well as the gear 12b1 of the feed roll 12. In this position, the drive force generated by the drive motor 50 is transmitted to the feed roll 12 and the front tractor 15, but not to the automatic sheet feeder 10.

When the second auxiliary cam 72 is rotated by a predetermined angle by the motor 61 as shown in FIG. 10(*a*), the idler gear 53 is axially moved toward the frame 72, to a position of FIG. 10(*b*), in which the idler gear 53 is disengaged from the gear 15*b* and in engagement with the two gears 12b1 and 12b2 on the shaft 12*a* of the feed roll 12. In this position, the drive force of the drive motor 50 is transmitted to the feed roll 12 and to the automatic sheet feeder 10 (pick-up and separator rolls 20, 24), but not to the front tractor 15.

When the auxiliary cam 72 is rotated by a further angle as shown in FIG. 9(*a*), the idler gear 52 is axially moved a further distance to a position of FIG. 9(*b*), in which the idler gear 53 is disengaged from the gear 12b1 of the feed roll 12. In this position, the drive force of the motor 50 is transmitted only to the feed roll 12, since the idler gear 53 is disengaged from the gears 15*b* and 12b2.

As shown in FIG. 5, an actuator lever 81 is provided so as to extend under the shaft 31*a* of the pinch roll 31. The actuator lever 81 is supported pivotally at its fixed end about a shaft 82, and has a contact portion 81*a* at its free end. The actuator lever 81 and the first auxiliary cam 70 are adapted so that the cam surface of the cam 70 engages the contact portion 81*a* when the cam 70 is rotated by the motor 61. In this arrangement, the actuator lever 81 is pivoted about the shaft 82 when the cam 70 is rotated. The shaft 31*a* of the pinch roll 31 is rotatably supported at its opposite ends by two bearings 83 which slidably engage respective elongate holes 84 formed in the left and right frames of the printer. The pinch roll (driven roll) 31, which is normally held in contact with the feed roll (drive roll) 30 by suitable biasing means, is separated from the feed roll 30 when the actuator lever 81 is pivoted upon rotation of the first auxiliary cam 70.

The first and second drive motors 50, 57 and the cam drive motor 61 are controlled by a microcomputer, which includes a central processing unit, a read-only memory and a random-access memory, as commonly known in the art. The microcomputer controls these motors 50, 57, 61, so as to feed the desired type of recording medium for printing thereon, in the following manner.

When printing is effected on the web 16 fed from the front tractor 15, the cam drive motor 61 is operated to rotate the cams 70, 72 and paper guide 71 to the positions of FIGS. 4, 8(*a*) and 8(*b*). In this condition, the paper guide 71 completes the web feed path for the web 16, as indicated in FIG. 4, and the drive force can be transmitted from the first drive motor 50 to the front tractor 15, as indicated in FIG. 8(*b*). Consequently, the web 16 is fed by the front tractor 16 and advanced toward the nip of the feed and pinch rolls 30, 31, along the web feed path partially defined by the paper guide 71, when the drive motor 50 is operated in the forward direction.

In the condition of FIGS. 4, 8(*a*) and 8(*b*), the idler gear 53 is not in mesh with the gear 12b2, and the transmission of the drive torque to the automatic sheet feeder 10 is shut-off. However, the feed roll 12*b* is rotated. To avoid feeding the manually inserted cut sheet 9, suitable means may be provided to separate the pinch roll 13 from the feed roll 12, when the web 16 is fed from the front tractor 15. Further, a sensor may be provided between the sheet inlet 9*a* and the feed roll 12, so that a printing operation on the web 16 is interrupted if the leading end of the cut sheet 9 manually inserted through the sheet inlet 9*a* is detected by the sensor.

The front tractor 15 is provided with a web sensor 88 adapted to detect the leading end of the web 16. By counting the number of command pulses applied to the drive motor 50 after the detection of the leading end by the web sensor 88, the position of the leading end of the web 16 while being advanced through the web feed path can be determined. This arrangement permits the cam drive motor 61 to be activated to place the printer in the position of FIG. 5, when the leading end of the web 16 has reached the nip of the feed and pinch rolls 30, 31.

In the position of FIG. 5, the paper guide 71 is moved away from the web feed path, and the actuator lever 81 is pivoted to separate the pinch roll 31 from the feed roll 30. The printing operation on the web 16 is effected in this condition. Since the web 16 has a relatively large thickness, the web 16 can be fed by the front tractor 15 up to the printing station, without the aid of the rolls 30, 31.

In the present embodiment wherein the front and rear tractors 15, 17 are driven by the respective drive motors 50, 57, one of the two tractors 15, 17 is operated in an ordinary printing operation. However, the two tractors 15, 17 may be simultaneously operated by the two motors 50, 57, so that printing is effected on two webs from the two tractors 15, 17, such that the two webs are arranged side by side in the direction of extension of the platen 2. Of course, the two motors 50, 57 are operated at different times, so that printing is first effected one of the two webs and is then effected on the other web.

When the printing is effected on the cut sheet 9 manually inserted through the sheet inlet 9*a*, the cam drive motor 61 is activated to rotate the auxiliary cams 70, 71 and paper guide 71 to the positions of FIGS. 6, 9(*a*) and 9(*b*). In this condition, the idler gear 52 meshes only the gear 12b1, whereby the drive force of the motor 50 is transmitted to the feed roll 12 only, with the automatic sheet feeder 10 and front tractor 15 disconnected from the motor 50. Accordingly, only the manually inserted cut sheet 9 is fed and advanced along the sheet feed path partially defined by the paper guide 71, when the motor 50 is operated.

In the condition of FIG. 6, the pinch roll 31 is held in rolling contact with the feed roll 30, and therefore the cut sheet 9 fed by the feed and pinch rolls 12, 13 is further advanced by the feed and pinch rolls 30, 31 toward the printing station. The printed cut sheet 9 is normally ejected onto the rear sheet stacker 35. However, the printed cut sheet 9 can be returned back to the sheet support 8, by operating the motor 50 in the reverse direction. In this respect, the paper guide 71 placed in the position of FIG. 6 permits the printed cut sheet 9 to be directed back into the path between the guide 71 and the sheet inlet 9*a*. It is also noted that the printed cut sheet 23 from the automatic sheet feeder 10 can also be returned to the sheet support 8, via the paper guide 71 placed in the sheet guiding position.

When the printing is effected on the cut sheets 23 delivered from the automatic sheet feeder 10, the cam drive motor 61 is operated to rotate the cams 70, 72 and paper guide 71 to the positions of FIGS. 7, 10(*a*) and 10(*b*). In this condition, the idler gear 53 is in mesh with the gears 12b1 and 12b2, and is disengaged from the gear 15*b*, as indicated in FIG. 10(*b*). Therefore, the drive force of the motor 50 is transmitted to the feed roll 12 and to the automatic sheet feeder 10, but not to the front tractor 15. As a result, the cut sheets 23 are delivered one after another from the stacker tray 22, by the pick-up and separator rolls 20, 24, and advanced to the printing station by the feed and pinch rolls 12, 13, 30, 31.

It will be understood from the foregoing explanation of the illustrated embodiment that the sheet feed path and the web feed path are selectively established by moving the paper guide 71, depending upon the recording medium to be used, i.e., whether the cut sheet 9, 23 or the web 16 is used. In the position of the paper guide 71 shown in FIG. 6, the printed cut sheet 9 can be returned to the sheet support 8 via the paper guide 71, even though the sheet feed path is bent while the web feed path is straight. The paper guide 71 prevents the cut sheet 9 from being returned toward the front tractor 15. Since the web feed path is straight, the web can be smoothly advanced toward the nip of the feed and pinch rolls 30, 31, and does not suffer from jamming, which would occur if the web feed path is curved as in the known printer. Thus, the instant printer assures reliable and accurate feeding and advancement of the web 16, for improved quality of printing on the web 16.

In the illustrated embodiment, the idler gear 53 is adapted to be axially movable on the shaft 53*a*, to shut-off the transmission of the drive force of the motor 50 to the front tractor 15 and/or automatic sheet feeder 10. Thus, the drive system including the motor 50 has the three positions: the position of FIG. 9(*b*) in which only the feed roll 12 is rotated; the position of 8(*b*) in which the feed roll 12 and the front tractor 15 are driven; and the position of FIG. 10(*b*) in which the feed roll 12 and the automatic sheet feeder 10 are driven. Since the single drive source in the form of the drive motor 50 is used for the feed roll 12, automatic sheet feeder 10 and front tractor 15, the printer as a whole is simplified in construction, and reduced in size and weight.

Since the front tractor 15 is operated through the drive gear 12b1 of the feed roll 12, the feeding of the web 16 takes place with the rotation of the feed roll 12, which is provided for the sole purpose of feeding the cut sheets 9, 23. However, a drive system for the front tractor 15 may be provided in addition to the drive system for the automatic sheet feeder 20 and front tractor 15. In this case, the feed roll 12 remains at rest while the front tractor 15 is operated.

While the present invention has been described in its presently preferred embodiment, with a certain degree of particularity, it is to be understood that the invention is not limited to the details of the illustrated embodiment, but may be embodied with various changes, modifications and improvements, which may occur to those skilled in the art, without departing from the spirit and scope of the invention defined in the following claims.

What is claimed is:

1. A printer comprising:

a printing portion for printing on a recording medium;

sheet feeding means for feeding a cut sheet as said recording medium along a sheet feed path, said sheet feeding means comprising a sheet supply portion from which said cut sheet is separately inserted into said sheet feed path, and a sheet driving device that partially defines said sheet feed path, said sheet driving device including means for moving said cut sheet in a selected one of a forward direction from said sheet supply portion toward said printing portion, and a reverse direction from said printing portion toward said sheet supply portion;

web feeding means for feeding a web as said recording medium along a web feed path, said web feeding means comprising a web supply portion from which said web is supplied, said web feed path extending between said web supply portion and said printing portion; and path switching means, disposed upstream of said printing portion as viewed in said forward direction, and including means for switching a feed path of said recording medium, from one of said sheet feed path and said web feed path to the other of said sheet feed path and web feed path, said path switching means further including means for guiding said cut sheet to be fed back along said sheet feed path from said printing portion to said sheet supply portion when said cut sheet is moved in said reverse direction by said sheet driving device;

wherein said sheet feed path includes a first portion between said sheet supply portion and said path switching means, and a second portion between said path switching means and said printing portion, said first and second portions being bent with respect to each other at said path switching means.

2. The printer according to claim 1, wherein said path switching means comprises a movable paper guide, and a moving device coupled to said movable paper guide, said moving device moving said movable paper guide between a sheet guiding position in which said movable paper guide guides said cut sheet along said sheet feed path, and a web guiding position in which said movable paper guide guides said web along said web feed path.

3. The printer according to claim 2, wherein said web feeding means comprises path defining means for defining a substantially straight path as said web feed path extending between said web supply portion and said printing portion.

4. The printer according to claim 3, wherein said sheet supply portion comprises a sheet inlet through which said cut sheet is manually inserted into said first portion of said sheet feed path, said paper guide placed in said sheet guiding position guiding said cut sheet toward said sheet supply portion through said sheet feed path and said sheet inlet while preventing said cut sheet from being moved back toward said web supply portion when said cut sheet is fed in said reverse direction by said sheet driving device.

5. The printer according to claim 1, wherein said sheet supply portion comprises a sheet inlet through which said cut sheet is manually inserted into said first portion of said sheet feed path and an automatic sheet feeder having a sheet stacker for accommodating a stack of cut sheets, said automatic sheet feeder delivering said cut sheets one after another from said sheet stacker to said first portion of said sheet feed path which extends between said sheet inlet and said path switching means, said cut sheets delivered from said automatic sheet feeder being fed to said printing portion by said sheet driving device through said sheet feed path.

6. A printer comprising:

a printing portion for printing on a recording medium;

sheet feeding means including a sheet inlet through which a cut sheet is manually inserted as said recording medium, an automatic sheet feeder having a sheet stacker for delivering cut sheets one after another from said sheet stacker as said recording medium, and a sheet driving device partially defining a sheet feed path and selectively moving said cut sheet manually inserted through said sheet inlet, and said cut sheets delivered from said automatic sheet feeder to said printing portion along said sheet feed path;

web feeding means for feeding a web to said printing portion along a web feed path as said recording medium;

a single drive source coupled to said automatic sheet feeder, said sheet driving device and said web feeding means and selectively driving said automatic sheet feeder, said sheet driving device and said web feeding means;

a power transmitting mechanism including (a) a first gear coupled to said sheet driving device, (b) a second gear coupled to said automatic sheet feeder, (c) a third gear coupled to said web feeding means, (d) an axially movable gear rotatable about an axis, and axially movable along said axis and engageable with said first, second and third gears, and (e) means for transmitting a drive force of said single drive source to said first gear, for transmitting said drive force to said automatic sheet feeder, said sheet driving device and said web feeding means; and power shut-off means including a gear moving device for moving said axially movable gear selectively to one of a plurality of operating positions along said axis, said plurality of operating positions including (i) a manual sheet feeding position wherein transmission of rotary motion of said first gear to said second and third gears is inhibited, thereby removing transmission of said drive force to said automatic sheet feeder and said web feeding means when said cut sheet manually inserted through said sheet inlet is fed along said sheet feed path, (ii) a web feeding position wherein transmission of rotary motion of said first gear to said second gear is inhibited and transmission of rotary motion of said first gear to said third gear is permitted, thereby removing transmission of said drive force to said automatic sheet feeder and applying transmission of said drive force to said web feeding means when said web is fed along said web feed path, and (iii) an automatic sheet feeding position wherein transmission of rotary motion of said first gear to said third gear is inhibited and transmission of rotary motion of said first gear to said second gear is permitted, thereby removing transmission of said drive force to said web feeding means and applying transmission of said drive force to said automatic sheet feeder when said cut sheets are delivered from said sheet stacker.

7. The printer according to claim 6, wherein said gear moving device includes gear biasing means for biasing said axially movable gear toward one of said manual sheet feeding position, said web feeding position and said automatic sheet feeding position, and an actuator for moving said axially movable gear against a biasing action of said biasing means, from said one position to the other positions.

8. The printer according to claim 7, wherein said gear moving device further includes a cam drive device, and said actuator comprises a gear moving cam which is driven by said cam drive device and which engages said axially movable gear to move said axially movable gear along said axis thereof.

9. The printer according to claim 8, further comprising:

a drive roll driven by said single drive source;

a driven roll having an operative position in which said pinch roll contacts said drive roll and cooperates with said drive roll to advance said recording medium, and an inoperative position in which said driven roll is spaced apart from said drive roll;

roll biasing means for biasing said pinch roll toward said operative position; and a roll moving cam driven with said gear moving cam, by said cam drive device to move said driven roll against a biasing action of said roll biasing means toward said inoperative position.

10. A printer comprising:

a printing portion for printing on a recording medium;

sheet feeding means including a sheet inlet through which a cut sheet is separately inserted and delivered as said recording medium, an automatic sheet feeder including means for delivering cut sheets one after another from a sheet feeder holding said recording medium, and a sheet driving device partially defining a sheet feed path leading to said printing portion, said sheet driving device including means for selectively moving said cut sheet separately inserted through said sheet inlet, and said cut sheets delivered from said automatic sheet feeder to said printing portion along said sheet feed path;

web feeding means for feeding a web as said recording medium to said printing portion along a web feed path which leads to said printing portion as said recording medium;

path switching means for switching a feed path of said recording medium from one of said sheet feed path and said web feed path to the other of said sheet feed path and web feed path, said path switching means being disposed upstream of said printing portion as viewed in a direction of feed of said cut sheet and said web toward said printing portion;

a single drive source coupled to said automatic sheet feeder, said sheet driving device and said web feeding means, and driving said automatic sheet feeder, said sheet driving device and said web feeding means;

a power transmitting mechanism coupled to said single drive source to transmit a drive force of said single drive source to said automatic sheet feeder, said sheet driving device and said web feeding means; and power shut-off means operated synchronously with said path switching means, for inhibiting transmission of said drive force from said single drive source to said automatic sheet feeder and said web feeding means when said path switching means selects said sheet feed path to feed said cut sheet separately inserted through said sheet inlet along said sheet feed path, said power shut-off means further inhibiting transmission of said drive force from said single drive source to said automatic sheet feeder when said path switching means selects said web feed path to feed said web along said web feed path.

11. The printer according to claim 10, further comprising a common actuator coupled to said path switching means and said power shut-off means, and actuating said path switching means and said power shut-off means synchronously with each other.

12. The printer according to claim 11, wherein said path switching means includes a movable paper guide having a first sheet guiding position wherein said paper guide guides said cut sheet which has been manually inserted through said sheet inlet along said sheet path, a second sheet guiding portion wherein said paper guide guides said cut sheets delivered from said automatic sheet feeder along said sheet feed path, and a web guiding position wherein said paper guide guides said web along said web feed path; and said power shut-off means including a movable member coupled to said power transmitting mechanism, said common actuator including a motor and a cam mechanism driven by said motor, and wherein said movable paper guide and said movable member are simultaneously operated by said motor through said cam mechanism.

13. The printer according to claim 12, wherein said common actuator further comprises a lever pivoted by said cam mechanism, wherein said lever carries said movable paper guide of said path switching means and said movable member of said power shut-off means.

* * * * *